US010621804B2

(12) United States Patent
Cheng Chuah

(10) Patent No.: US 10,621,804 B2
(45) Date of Patent: Apr. 14, 2020

(54) TOOLS AND METHODS FOR BALLOT COUNTING

(71) Applicant: Jack Teo Cheng Chuah, Singapore (SG)

(72) Inventor: Jack Teo Cheng Chuah, Singapore (SG)

( * ) Notice: Subject to any disclaimer, the term of this patent is extended or adjusted under 35 U.S.C. 154(b) by 195 days.

(21) Appl. No.: 15/852,316

(22) Filed: Dec. 22, 2017

(65) Prior Publication Data

US 2018/0211466 A1 Jul. 26, 2018

(30) Foreign Application Priority Data

Jan. 24, 2017 (SG) ..... 10201700580

(51) Int. Cl.

| | |
|---|---|
| ***G07C 13/00*** | (2006.01) |
| ***B42D 25/351*** | (2014.01) |
| ***B42D 15/00*** | (2006.01) |
| ***B42D 25/313*** | (2014.01) |
| ***B42D 25/305*** | (2014.01) |

(52) U.S. Cl.

CPC ..... *G07C 13/00* (2013.01); *B42D 15/004* (2013.01); *B42D 25/305* (2014.10); *B42D 25/313* (2014.10); *B42D 25/351* (2014.10)

(58) Field of Classification Search

CPC .. B42D 25/305; B42D 25/313; B42D 25/351; B42D 15/004

USPC ..... 235/51, 56, 386

See application file for complete search history.

(56) References Cited

U.S. PATENT DOCUMENTS

| | | | | |
|---|---|---|---|---|
| 7,210,617 | B2 * | 5/2007 | Chaum | G07C 13/00 235/386 |
| 7,516,891 | B2 * | 4/2009 | Chaum | G07C 13/00 235/386 |
| 2003/0158775 | A1 * | 8/2003 | Chaum | G07C 13/00 705/12 |
| 2007/0095909 | A1 * | 5/2007 | Chaum | G07C 13/00 235/386 |

* cited by examiner

*Primary Examiner* — Paultep Savusdiphol
(74) *Attorney, Agent, or Firm* — The Webb Law Firm

(57) ABSTRACT

The present application relates to one or more tools for a ballot counting tool that comprises a predetermined number of fields for receiving ballot sheets to the predetermined number of fields respectively; and one or more catches or binders for attaching the ballot sheets to their respective fields.

20 Claims, 6 Drawing Sheets

TOOLS AND METHODS FOR BALLOT COUNTING

CROSS-REFERENCE TO RELATED APPLICATION

This application claims priority to Singaporean Patent Application No. 10201700580T filed Jan. 24, 2017, the disclosure of which is hereby incorporated in its entirety by reference.

BACKGROUND OF THE INVENTION

Field of the Invention

The present application relates to one or more tools for ballot counting. The application also relates one or more methods for making, assembling, disassembling, installing, configuring, maintaining, repairing and using the one or more tools for ballot counting.

Description of Related Art

In a voting campaign, paper ballots are specially printed according to specific formats. Voters are to mark on the paper ballots to indicate their choices of candidates. The paper ballots are then casted into one or more designated ballot boxes. At an end of the vote campaign, the one or more designated ballot boxes are opened, and the paper ballots are subsequently retrieved, compiled and counted manually by hand. Counting of the paper ballots is time consuming, labour intensive, and thus prone to error. In the event of a recount exercise, the process of manual counting repeats. Although there are electronic voting machines available in the market that use digitally captured images of the paper ballots for counting, the electronic voting machines present another problem as machine scanned images of the paper ballots may be easily tampered. Consequently, the electronic voting machines may cause the voting campaign to be insecure, and potentially compromise integrity of the voting campaign. Therefore, it is the object of the present application to provide tools and methods which facilitate secure, accurate and efficient ballot counting exercises.

SUMMARY OF THE INVENTION

The present inventions aim to provide one or more new and useful ballot counting tools, which are also known as tally record sheets. The present inventions further aim to provide one or more new and useful methods for making, assembling, disassembling, installing, configuring, maintaining, repairing and using the one or more tools for ballot counting. Essential features of the inventions are provided by one or more independent claims, whilst advantageous features are presented by their dependent claims respectively.

According to a first aspect, the present application provides a ballot counting tool that comprises a predetermined number of fields for receiving ballot sheets to the predetermined number of fields respectively; and one or more catches or binders for attaching the ballot sheets to their respective fields. Since the ballot counting tool has prearranged or fixed number of fields or slots, a person or machine can easily determine the number vacant or validated ballot. For example, the ballot counting tool is a piece of A2 size paper with twelve slots. The ballot counting tool has twelve rectangular regions of the same size. Each of the regions is configured to receive and affix a ballot paper that fits snugly. Once all regions of the ballot counting tool is full of ballot papers, the person can easily count the total number of valid votes by counting the slots filled with ballot papers. The ballot counting tool thus offers a simple, reliable and low cost ballot counting tool that is also adaptable to various voting situations. Diverse types of slots, languages, ballot sheets are applicable to the ballot counting tool. Besides, since the ballot counting tool has the fixed number of fields or slots, recount or archiving of the ballot sheets becomes straightforward, requiring much less manpower or having much little room for error. The ballot counting tool is also known as a tally record sheet. The ballot sheet is also known as a ballot paper.

Some embodiments of the application provide the fields or the catch that are detachable, such that the ballot counting tool is reusable. For example, the fields include multiple pockets for receiving ballot sheets respectively. A ballot sheet is easily inserted into the pocket or conveniently removed from the pockets such that a used ballot sheet is able to be reused by removing previously filled pockets.

Embodiments of the application also provides a ballot counting tool whose predetermined number of fields are adjacent or contiguous each other. The ballot counting tool may be made of paper, plastic sheet or other flexible materials. A single piece of ballot counting tool is able to accept more ballot sheets once the predetermined number of fields are close to each other, wasting less space. For example, the predetermined number of fields are tessellating to each other, whereby areas between the predetermined number of fields are almost eliminated.

The ballot sheet can comprise one or more types of adhesive on one or more surfaces for adhering to another surface and a plurality of fields on a second surface for showing instruction and collecting information.

The function of the ballot sheet is to instruct a voter to choose a preferred choice and to have information of the voter's choice by having the voter expressly marked his or her choice on the ballot sheet either by a writing tool, perforating through a perforated section or other means.

The adhesive may adhere the ballot sheet to another surface on the ballot counting tool. The adhesive can be a reactive or non-reactive adhesive, such as a multi-part adhesive using polymers reacting to each other or a pressure-sensitive adhesive respectively.

The adhesive can be applied at a specific location or on the whole surface depending on its use and function. If the ballot sheet is to be permanently affixed to another surface, then the whole surface of the ballot sheet can be applied with adhesive. Conversely, if the ballot sheet is to be removed, a not so aggressive adhesive may be used like the pressure-sensitive adhesive.

The ballot sheet can be of different sizes in length depending on the use of the voting campaign. The size of the ballot sheet can be manufactured according to the number of fields, size of the printed matter et cetera.

The ballot sheet can be of different opacity depending on the desired use. If the ballot sheet is non-reusable, an opaque material will be preferred. However, if the ballot sheet is to be reused a clear plastic-like film may be used. The voter's choice may be marked on the plastic-like film by ink that is removable by a specific method.

The ballot sheet has an identification code for compiling multiple pieces of the ballot sheet which is machine readable like a bar code, a quick response (QR) code, a radio frequency identification (RFID) or hologram.

The one or more catches can comprise a transparent covering over one of the predetermined fields in forming a pocket for keeping one of the ballot sheets. The transparent covering provides temporary or permanent fixture to the ballot sheet onto the ballot counting tools so that the ballot sheets are prevented from dropping off or shifting on the ballot counting tool, especially during counting. If required to be kept permanently, such as for archiving, the ballot counting tool and the transparent covering form a lamination pouch such that a heat-activated film is able to adhere to the ballot sheets, the ballot counting tool or both for sealing the ballot sheets. The transparent covering, the ballot sheet, the ballot counting tool, the adhesive or any other parts can be reusable or non-reusable (i.e. permanent).

The one or more catches may further comprise one or more recesses for affixing one or more of the ballot sheets respectively. The one or more recesses are able to keep the ballot sheets without deforming or distorting the ballot counting tool, providing much convenience for stacking multiple pieces of the ballot counting tools.

The one or more catches can further comprise adhesive for affixing one of the ballot sheets to one of the predetermined number of fields. The adhesive provides either temporary or permanent fixing of the ballot sheets to the ballot counting tool so that the ballot counting tool is cheap to produce or deploy.

The one or more catches may further comprise one or more fasteners for affixing one of the ballot sheets to one of the predetermined number of fields. The fastener includes clips, clasp, binder, rivet or any other fixing tools that fasten the ballot sheets to the ballot counting tools in order to prevent miscounting.

The predetermined number of fields are optionally aligned horizontally, vertically or both horizontally and vertically on the ballot counting tool according to a regular pattern for easy counting or visualisation. Alternatively, the predetermined number of fields are plotted on the ballot counting tool according to regular pattern such that a reader (e.g. officer or machine) is to determine result of the balloting easily, such as by visual observation.

In some cases, the predetermined number of fields are aligned to a grid pattern such that either a machine or an officer is able to calculate the number of balloting immediately by viewing. Instead of counting ballot sheets piece by piece, the grid pattern offers an accurate and simple pattern for tabulating.

One or more of the predetermined number of fields sometimes comprise one or more transparent covering for visual inspection. For example, the one or more of the predetermined number of fields are windows on the ballot counting tool that is covered by a transparent polyethylene film. A person can easily observe if any of these fields are filled by ballot sheets, thereby numbering the total number of votes. Alternatively, the transparent covering is made of polypropylene, polyester, Nylon, polyvinyl chloride, or a variety of bioplastics and biodegradable plastic films.

The ballot counting tool can further comprise an identification code for compiling multiple pieces of the ballot counting tool. The identification code provides unique codes to each of the ballot counting tool so that tampering of the ballot counting tool is prevented, and voting with the ballot sheets is protected. For example, the identification code includes a numerical serial number that is printed on the ballot counting tool, and is easily readable by officers of balloting. Addition or removal of any authentic ballot counting tool is avoided by monitoring sequential arrangement of the ballot counting tool according to the identification code.

The identification code may comprise a machine readable identification code (e.g. barcode) or machine-readable medium (automated data medium). The readable identification code includes many types, such as barcode (e.g. matrix barcode or two-dimensional barcode), magnetic strip, punched card or Magnetic ink character recognition code (MICR Code). Whether accompanied by the human readable identification code, the machine readable identification code enables machine to utilise the ballot counting tool effectively and efficiently, saving much human effort and avoiding much counting mistakes.

Embodiments of the application provide a machine readable identification code that comprises an electronic identification (e.g. RFID chip). The electronic identification provides a digital signature, which is optionally embedded in a RFID microchip or an electronic circuitry (e.g. coils of spiraled metallic wires). The RFID chip stores information printed of the ballot counting tool or ballot sheets (e.g. ballot validation code, biometric photos, fingerprints). So that forgery of the ballot counting tool or ballot sheets are largely prohibited.

The ballot counting tool may further comprise a clasp for joining another ballot counting tool. The clasp is hanging or binding instrument that bundles several ballot counting tools together. In storage, the clasp further prevents entanglement or mixing up of numerous ballot counting tools, providing convenience and clarity to balloting.

The clasp can be detachable from the ballot counting tool. When detached, the clasp can be reused for other balloting, and will not make the ballot counting tool to be bulky during storage or packaging.

The ballot counting tool may be tear resistant (i.e. tear proof), fire resistant, waterproof, dust resistant, pest resistant, smear resistant, fireproof or a combination of any of these properties (e.g. laminated paper). Hence, the ballot counting tool becomes more robust, and flexible for being deployed in diverse situations. For example, the ballot counting tool is able to be used outdoors or rural areas if it is made waterproof, facing possible rains.

The ballot counting tool can be foldable, pliable for being rolled up such that the ballot counting tool can be stored with the minimum space, being compact. Large volumes of the ballot counting tools are possible to be stored in manufacturing warehouse, government agencies or storerooms of domestic residences.

According to a second aspect, the present application provides a ballot sheet for being counted by the ballot counting tool. The ballot sheet is alternatively known as a ballot sheet that comprises a predetermined number of areas for balloting; and an area for providing identification of a voter. The ballot sheet is configured to be affixed to the ballot counting tool for tabulating ballot tools. Since multiple pieces of the ballot sheet are able to be attached to the predetermined number of areas respectively, a balloting officer can easily visualise a missing area that are not covered by the ballot sheet. The balloting officer can immediately know the number of votes, and get information of the missing ballot sheet. In other words, even if a voter does not cast his/her ballot, the balloting officer can obtain accurate and timely information of the missing ballot sheet or absent voter. An entire balloting exercise becomes more objective, informative and accurate.

Embodiments of the application provides that the balloting sheet is tear resistant, fire resistant, waterproof, dust resistant, pest resistant, smear resistant or a combination of any of these properties (e.g. made by laminated paper).

Hence, the ballot sheet is able to be kept for a prolonged period of time, easily recycled if required and durable for subsequent verification.

The ballot sheet or ballot counting tool can comprise one or more disability assistive features for balloting (e.g. tactile features, enlarged prints, audio, punctured) by disabled people. Disabled people are thus empowered and well informed by relevant balloting process by using the friendly ballot counting tool (e.g. tally record sheet) or ballot sheet (e.g. ballot paper).

Embodiments of the application provides the ballot sheet that further comprises an adhesive for attaching to one or more of the predetermined fields. One or more portions of the ballot sheet may be translucent, transparent or opaque. The ballot sheet can comprise an adhesive on at least one surface for adhering to another surface; and a plurality of fields on a second surface for showing instruction and collecting information. The adhesive may be applied at a specific location or on the whole surface depending on its use and function. The ballot sheet can be of different sizes in length depending on the desired use. The ballot sheet can be of different opacity depending on the desired use. The ballot sheet can further in incorporate an identification code for compiling multiple pieces of the ballot sheet. The identification code may comprise a machine readable identification code. The machine readable identification code can comprise an electronic identification.

According to a third aspect, the present application provides a ballot counting machine that comprises a receptacle for receiving the one or more pieces of the ballot counting tool (or ballot tool); a dispenser discharging the at least one ballot counting tool; and a counter for numbering the at least one ballot counting tool or balloting sheets on the one or more ballot counting tools when transferring from the receptacle to the dispenser). The one or more ballot counting tools are configured to fix the ballot sheets to the one or more ballot counting tools for reading by the counter. When handled by the ballot counting machine, integrity of the ballot counting tool or the ballot sheet is preserved, which permits repeated handling by the ballot counting machine or human beings.

The counter may comprise a machine reader for capturing information on the one or more ballot counting tools or the balloting sheets. The machine reader provides efficient and reliable readings so that ballot result of the ballot counting machine become trust-worthy.

The ballot counting machine can further comprise a sorter for organising multiple pieces of the one or more ballot counting tools. The sorter makes the multiple pieces of the one or more ballot counting tools neat and compact, being easy for subsequent handling.

According to a fourth aspect, the present application provides a method for using a ballot counting tool. The method comprises a first step of providing balloting sheets; a second step of attaching the balloting sheets to a predetermined number of fields on the ballot counting tool respectively; and a third step of calculating or validating the balloting sheet according to the predetermined number of fields. Some of these steps may be separated, integrated or changed in sequence. The method facilitates easy counting of valid votes, and also simple recording of missing votes.

The method can further comprise a step of compiling multiple pieces of the ballot counting tool for determining balloting result. Once bundled together, a large number of the ballot counting tool become compact and have similar orientation for easy storage.

According to a fifth aspect, the application provides a method for making a ballot counting tool. The method comprises a first step of providing a predetermined number of fields for receiving ballot sheets to the predetermined number of fields respectively; and a second step of compiling multiple pieces of the ballot counting tool together. For example, the ballot counting tools share the same orientation so that the ballot counting tools can be snugly packed into a small container. Some of these steps may be separated, integrated or changed in sequence.

The method additionally may comprise a step of packaging, transporting, distributing, sorting or labelling the ballot counting tool. Following these techniques, the ballot counting tool or ballot sheet is able to be distributed to many districts, counties, states or countries so that the society at large is able to benefit from the relevant methods.

According to a sixth aspect, the present application provides a ballot counting tool (e.g. tally record sheet) that comprises a sheet material having a predetermined number of receptacles (e.g. pocket, field) for receiving ballot papers respectively; and one or more catches on the sheet material for keeping the ballot sheets to the receptacles respectively. The predetermined number of receptacles include areas that are marked out for receiving or adhering the ballot papers respectively. The one or more catches include holders, anchors, clasps, fasteners, grabber or any other devices for affixing a ballot paper onto the ballot counting tool steadily, whether permanently or detachably. Since the ballot counting tool is able to show the predetermined number of receptacles prominently, receptacles that do not have any ballot papers attached become ostensibly visible. Balloting officers or a ballot counting machine can easily perceive the missing receptacles when counting votes, making the counting process accurate, reliably, repeatable, verifiable and easy.

The ballot counting tool can further comprise a roughened area on the sheet material for easy holding of the ballot counting tool. The roughened area allows easy catching to the ballot counting tool by a human hand or machine parts. The roughened area comprises a rail, a rubber stripe, an array of punctured holes (also known as perforations) for transporting the ballot counting tool by sprockets and claws of a ballot counting machine. For example, a lineally aligned circular holes are easily held by registration pins of the ballot counting machine, which holds the ballot counting tool steadily for processing. One embodiment of the application provides the ballot counting tool comprises two arrays of punctured holes that are placed at opposite sides of the sheet material. The two arrays of punctured holes are aligned with longitudinal edges of the sheet material respectively so that the sprockets and claws of the ballot counting machine can easily capture, withdraw, and shift positions of the sheet material for aligning the ballot counting tool with sensors of the ballot counting machine for reading information automatically.

The one or more catches may comprise a transparent layer for covering the ore or more predetermined receptacles (also known as fields). For example, the transparent layer and the sheet material forms pockets as the receptacles for keeping the ballot sheets to their respective places securely. The transparent sheet allows visible inspection to the ballot counting tool, but does not comprise on fastening of the ballot sheets.

Embodiments of the application provide that the one or more catches further comprise an adhesive, an adhesive layer or a reusable adhesive layer (e.g. low-tack pressure-sensitive adhesive) for affixing the ballot sheets to the predetermined number of receptacles. The adhesive is also known as glue, cement, mucilage, or paste for binding the ballot paper to a receptacle on the ballot counting tool together and resisting their separation. For example, the adhesive includes one or more hot adhesives (i.e. types of thermoplastics) that are applied to opposite surfaces of the ballot counting tool and the ballot paper, and the hot adhesive only cured by heat ranging from 65~180° C.

The one or more catches can further comprise one or more fasteners for affixing the ballot sheets to the predetermined number of receptacles, whether detachably or permanently. Examples of the fasteners include cable ties, clips, clutches, pins, retaining rings, straps, et cetera. The one or more fasteners facilitate attaching of the ballot sheet to the ballot counting tool.

The predetermined number of receptacles optionally are aligned on the ballot counting tool according to a regular pattern. For example, the predetermined number of receptacles are aligned in one dimension, two dimensions (e.g. a grid pattern). Often, multiple receptacles are aligned on a surface of the sheet material in X-axis and Y-axis according to a Cartesian coordinate system such that the multiple receptacles provide a rectangular pattern, which is visually easy for counting.

The ballot counting tool may additionally comprise one or more identification codes for organising multiple pieces of the ballot counting tool. For example, the ballot counting tool has a unique identification code that is associated a specific ballot counting tool so that imposter or fraudulent ballot counting tools are readily prevented. For example, the ballot counting tool include a serial number or a machine readable identification code. For instance, the machine readable identification code includes a Radio-frequency identification (RFID) tag that is affixed to the ballot counting tool. The RFID tag is an embedded electronic circuit that facilitates automatic tracking of the ballot counting tool. Of course, the machine readable identification code further includes one or more punched tapes or perforated paper tapes (e.g. Fanfold paper tape.) which are possible to be read by the ballot counting machine, alternatively known as computer punched card reader or just computer card reader. If implemented by electronic circuits (e.g. antenna), the machine readable identification code may comprise one or more electronic identifications (e.g. digital signature, barcode, Matrix barcode, QR code).

The ballot counting tool can additionally comprise one or more through holes at predetermined locations of the sheet materials for joining another ballot counting tool, such as by compiling or stacking orderly. The one or more through holes can be inserted with a shaft in order to stack and align multiple pieces of ballot counting tools. Optical readers can easily detect aligned through holes of multiple ballot counting tools so that sorting, stacking and counting of the multiple ballot counting tool becomes viable.

Embodiments of the application provide that one or more portions of the ballot counting tool are tear resistant, fire resistant, waterproof, dust resistant, pest resistant, smear resistant, flexible, foldable or having a combination of any of these properties or characteristics. The ballot counting tool thus become versatile, durable or adaptable to various balloting situations.

According to an eighth aspect, the present application provides a ballot sheet for being counted by the above-mentioned ballot counting tool. The ballot tool comprises a predetermined number of zones showing information of candidates for balloting; an area on the ballot sheet showing identification information of a voter; and a non-detachable part having an identifier of the ballot sheet, the voter, the ballot counting tool or a combination of any of these. The ballot tool (i.e. ballot sheet, ballot paper) offers a simple, reliable and low cost tool to voters so that a balloting exercise can be easily carried out, with reduced chances of mistakes or fraudulent voting. For example, since many pieces of the ballot sheet are configured to be affixed to the ballot counting tool for tabulating ballot tools, balloting results can be quickly and accurately obtained by checking the ballot counting tool. Embodiments of the application additionally provides that the balloting sheet is tear resistant, fire resistant, waterproof, dust resistant, pest resistant, smear resistant or having a combination of any of these properties.

The ballot sheet can further comprise one or more disability assistive features for balloting. For example, the ballot sheet has rectangular blocks called cells that have tiny bumps called raised dots according to a tactile writing system (e.g. Braille as fine protrusions). Hence, the ballot sheet will greatly assist people with disabilities in voting or balloting.

Similar to the ballot counting tool, the ballot sheet optionally further comprises an adhesive for attaching to one or more of the predetermined fields. Moreover, one or more portions of the ballot sheet can be translucent or semi-translucent, whether printed with text or graph. The ballot sheet may have an identifier or identification code that comprises an electronic circuit (e.g. antenna, RFID chip) for tracking the ballot sheet automatically. Thus, an unauthorised ballot sheet is easily detected by a transmitter pedestal and a receiver pedestal of the RFID chip at a balloting centre.

According to a ninth aspect, the present application provides a ballot counting machine that comprises a receptacle for receiving the one or more ballot counting tools mentioned above; a dispenser discharging the at least one ballot counting tool; and a counter for numbering the one or more ballot counting tools or balloting sheets on the one or more ballot counting tools. The one or more ballot counting tools are configured to fix the ballot sheets to one or more ballot counting tools for reading by the counter.

The counter optionally comprises a machine reader for capturing information on one or more ballot counting tools or the balloting sheets. The machine reader includes optical reader (Optical Character Recognition machine or Optical Character Reader) or other types of computerised readers (e.g. EMV reader) that can read stored information from integrated circuits or magnetic stripes (for backward compatibility) on the ballot counting tool or the ballot sheet. Reading of the ballot sheet or ballot counting tool is optionally through physical contact (e.g. reading magnetic stripes) or contactless (e.g. through a short distance). Data stored on the ballot sheet or ballot counting tool optionally follow EMV (Europay, Mastercard, Visa), which is a technical standard for smart payment cards, payment terminals and automated teller machines.

The sorter can be configured to organise, stack or staple multiple pieces of the ballot counting tool automatically. For example, a modified cash sorter machine can be used for sorting ballot sheets or ballot counting tools. The ballot counting machine may a tracking tool to locate the ballot counting machine. For example, the tracking tool includes a GPS-enabled device that is able to record and store location data at a pre-determined interval or on interrupt by an environmental sensor. These data may be stored pending recovery of the GPS-enabled device or relayed to a central data store or internet-connected computer using an embedded cellular (GPRS), radio, or satellite modem. The geographical location of the ballot counting machine, the ballot sheet or ballot counting tool can then be plotted against a map or chart in near real-time or, when analysing the tracking tool later, using a GIS (Geographic Information Systems) package or custom software.

The ballot counting machine may further comprise a communication terminal for transmitting electronic signal with a remote electronic device. The communication terminal may have wired or wireless communication capabilities. For example, the communication terminal has a computer port, such as a parallel port, a serial port, a USB (Universal Serial Bus) port, a SCSI (Small Computer System Interface) port. The communication terminal is optionally able to communicate with telecommunication networks automatically, such as via computer networks, Internet, telephone networks, global Telex network and aeronautical ACARS network.

The ballot counting machine can further comprise a unique electronic address as identification of the ballot counting machine. The unique electronic address includes a machine readable number or code, a physical trait or parameter, or a combination of any of these. Examples of the electronic address include a Wi-Fi MAC (Media Access Control) address, an IPv4 (Internet Protocol version 4) address, an IPv6 (Internet Protocol version 6) address, an IMEI (International Mobile Equipment Identity) address, a telephone number, a MSISDN (Mobile Station Integrated Services Digital Network number), an international mobile subscriber identity (IMSI) number and its related key as stored by a SIM (subscriber identity module or subscriber identification module) card, an Integrated Circuit Card Identifier (ICCID), a Bluetooth address, Ethernet MAC (Media Access Control) address. Examples of the machine-readable number, machine-readable code or machine-readable data includes a serial number, a time stamp, a linear barcode and a matrix (2D) barcode (e.g. Quick Response Code, Data Matrix code).

According to a tenth aspect, the present application provides a method for using the ballot counting tool as mentioned above. The method comprises a first of providing balloting sheets; a second step of attaching the balloting sheets to a predetermined number of fields on the ballot counting tool respectively; and a third step of calculating the balloting sheet according to the predetermined number of fields. Some of these steps are optionally combined, changed in sequence or divided. The method provides a convenient and reliable process of counting votes or ballots. The method can further comprise a step of compiling multiple pieces of the ballot counting tool for determining balloting result. The ballot counting tool offers a simple yet reliable means to conduct ballot counting.

According to an eleventh aspect, the present application provides a method for making a ballot counting tool. The method comprises a step of providing a predetermined number of fields for receiving ballot sheets respectively; and another step of compiling multiple pieces of the ballot counting tool. One or more of these steps are optionally combined, changed in sequence or divided. The method can further comprise a step of packaging the ballot counting tool. The method may additionally comprise a step of embedding one or more electrical coil therein. The method offers manufacturing and handling techniques of the ballot counting tool, which is cost saving and simple to improvise by technicians of a workshop or other unskilled works.

According to a twelfth aspect, the present application provides a method for assembling the tally record sheets or ballot counting tools. The method comprises a first step of forming an adhesive sheet with a top surface having an adhesive; a second step of perforating the liner sheet with perforated lines forming a plurality of area; a third step of applying the liner sheet onto the adhesive sheet; a fourth step of perforating the backing sheet with perforated lines forming a plurality of area; a fifth step of applying the backing sheet with the perforated areas onto the corresponding perforated areas of the liner sheet; a sixth step of embedding the electronic tracking circuit; and a seventh step of inscribing and embossing on the ballot medium. Some of these steps are optionally combined, changed in sequence or divided.

BRIEF DESCRIPTION OF THE DRAWINGS

The accompanying figures (Figs.) illustrate embodiments and serve to explain principles of the disclosed embodiments. It is to be understood, however, that these figures are presented for purposes of illustration only, and not for defining limits of relevant inventions.

DESCRIPTION OF THE INVENTION

Exemplary, non-limiting embodiments of the present application will now be described with references to the above-mentioned figures.

Figure 1:
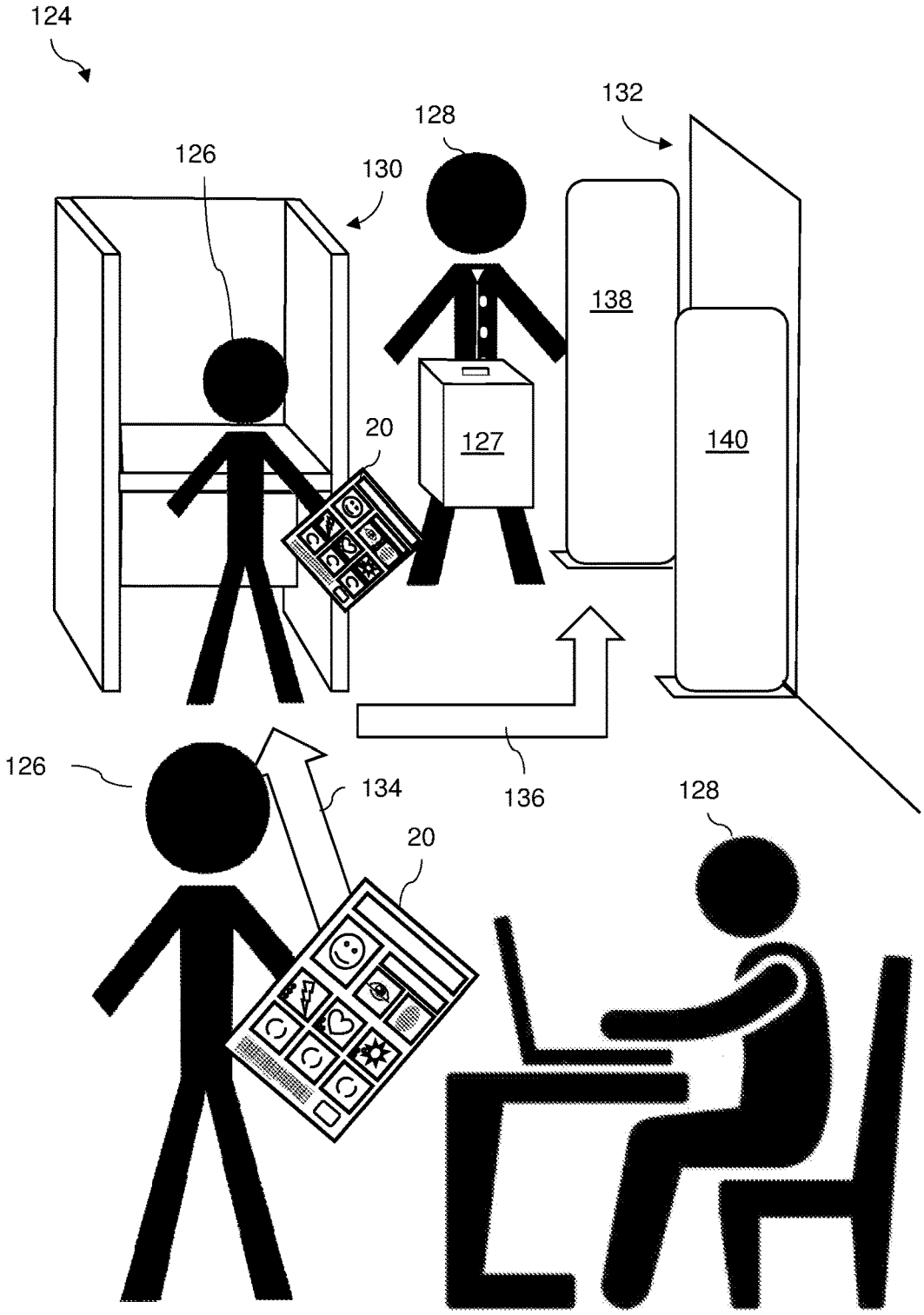
FIG. 1 is a schematic view of a polling centre according to the principles of the present invention.

FIG. 1 illustrates a polling centre 124. The polling centre 124 has two arrows on a floor. A first arrow 134 guides a voter 126 from the polling official 128 to the polling station 130. A second arrow 136 guides the voter 126 who had already voted to an exit 132 at a right side. Before the voter 126 exits the polling centre 124, the voter 126 cast his vote into a ballot box 127 guarded by a second polling official 128.

At a background, the voter 126 with a piece of ballot paper 20 is at the polling station 130. At a foreground, the polling official 128 is seated on a chair in front of a computer taking attendance of the voter 126 before handing the voter 126 a ballot paper 20. Before the exit 132, there is a transmitter pedestal 138 and a receiver pedestal 140 erected. Straight after the polling, the ballot papers 80 which are cast in a ballot box 127 is then opened and counted.

Figure 2:
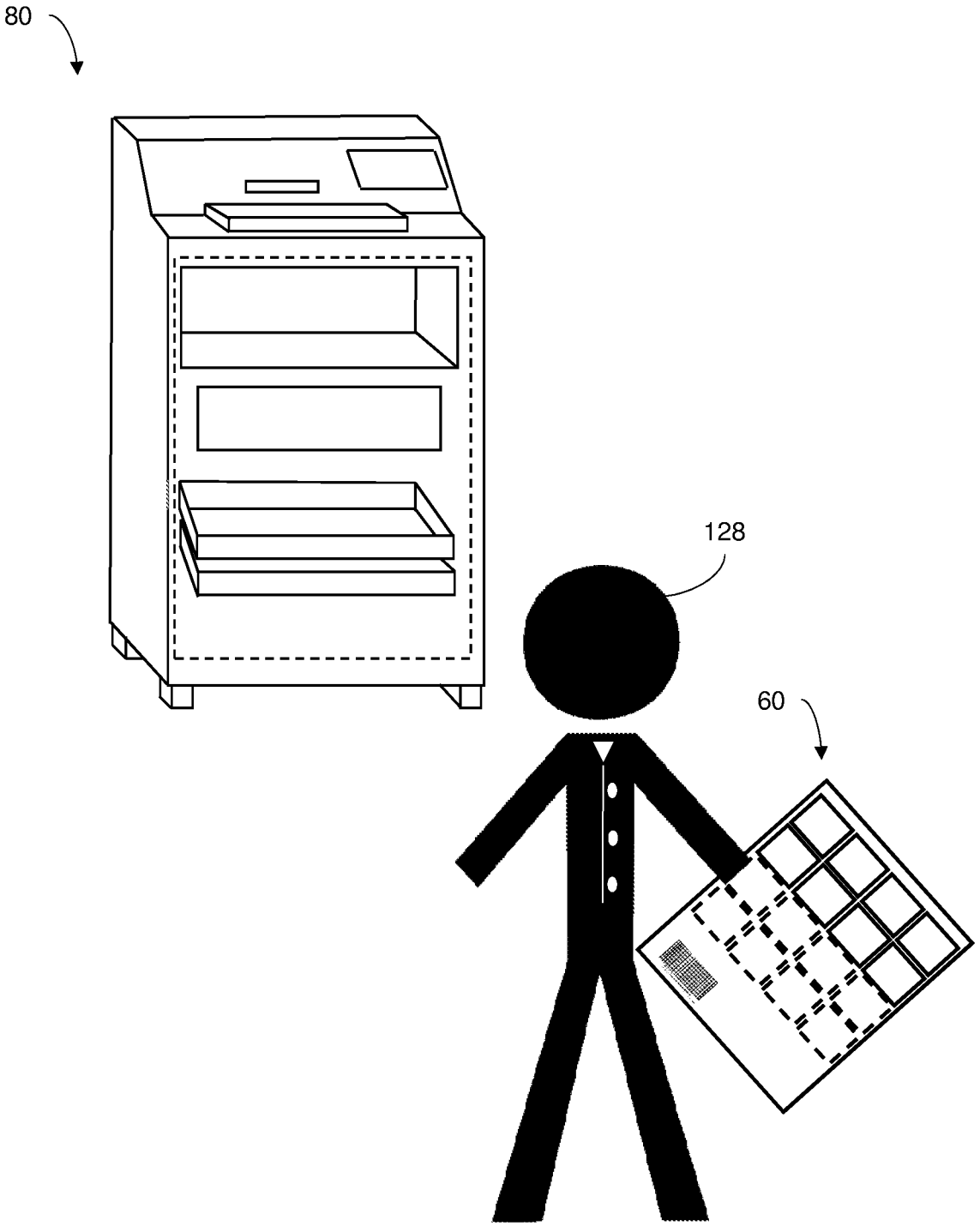
FIG. 2 is a schematic view of a ballot counting machine and a tally record sheet according to the principles of the present invention.

FIG. 2 illustrates a ballot counting machine 20 and a tally record sheet 100. The tally record sheet 100 is held by the polling official 128 which is to be inserted into the ballot counting machine 20.

Figure 3:
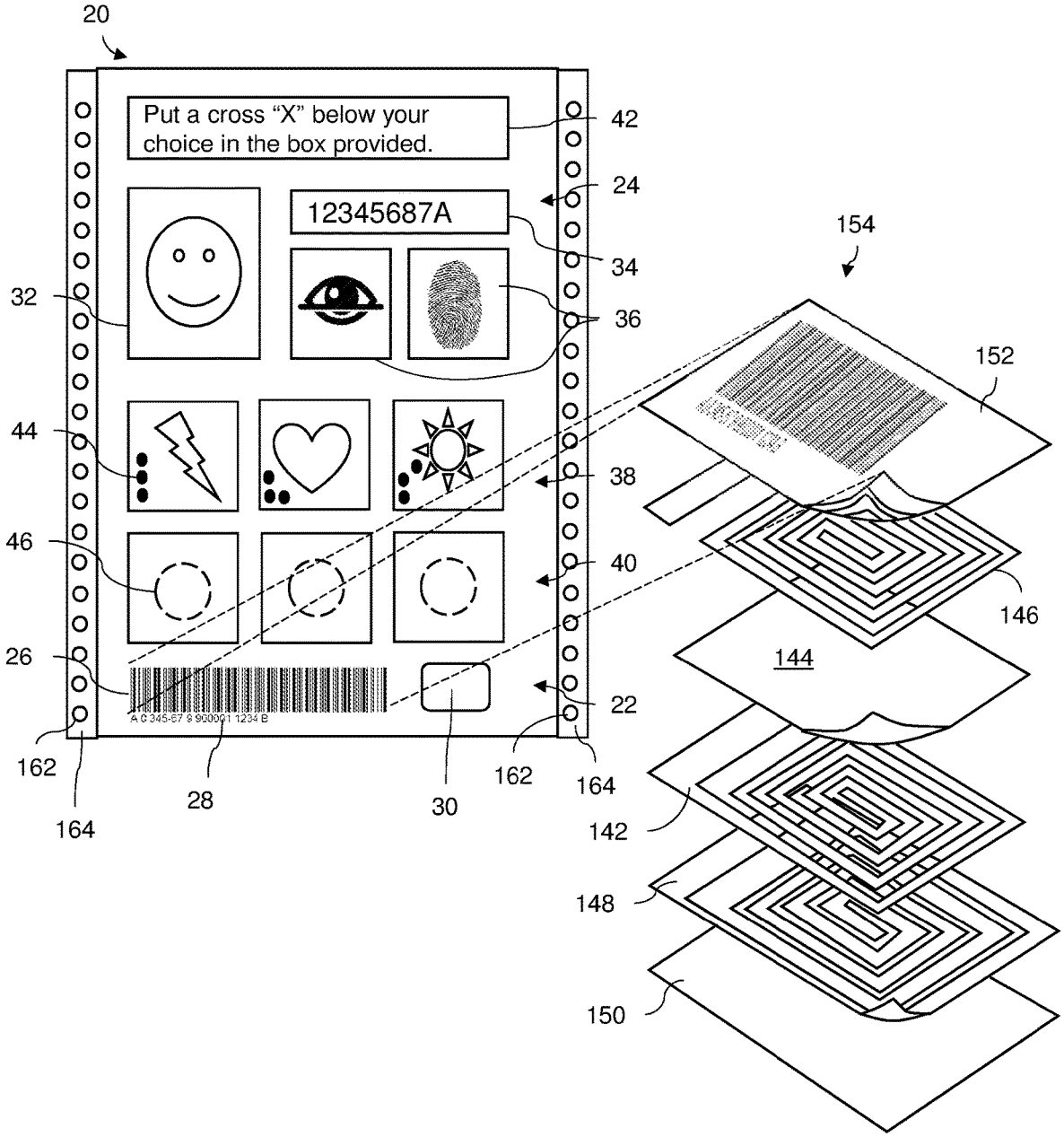
FIG. 3 is a schematic view of a ballot paper according to the principles of the present invention.

FIG. 3 illustrates a ballot paper 20 comprises a ballot identity code 22, a voter identity 24, a list of choices 38, a field of vote 40 and a ballot instruction field 42. The ballot paper 20 is a soft, flexible, water-proof and tear resistant paper that is laminated (i.e. layered) and is made of a synthetic material. A trade name of the tear resistant paper is "Ruff N Tuff", which is remarkably difficult to tear. Along the two long sides of the ballot paper 20 is a plurality of through holes 162. The through holes 162 are made on a laminated strip 164. The laminated stripe 164 has a transparent appearance and a rough surface. The laminated strip 164 strengthens and maintains the integrity of the through holes 162 and are on both sides of the two long sides (length). The through holes 162 provide a means for feeders (not shown) of a ballot counting machine with protrusions to grasp onto the ballot paper 20 and rolls into a ballot counting machine 80. Alternatively, the rough surfaces can be formed on between the though holes 162 only and not the whole laminated strip 164.

The ballot paper 20 has an electronic article surveillance (EAS) tag 154 embedded using radio frequency. The EAS tag is an inductor-capacitor tank circuit that has a resonance peak from 1.75 Mega Hertz (MHz) to 9.5 Mega-Hertz (MHz). The EAS tag 154 is formed using thin film technology. An insulation layer 148 is etched with a helical trench. The insulation layer 148 is laid on a top surface of the ballot paper 150. A lower metal coil layer 142 is laid above the insulation layer 148. A dielectric material is interposed between the lower metal coil layer 142 and an upper metal coil layer 146. A top surface of the barcode label 152 conceals the circuitry below and making it invisible to the voter 126. The metallic coil is wound within the perimeter of the top surface of the barcode label 152 which acts as an antenna and connected to a thin-filmed inductor-capacitor tank circuit.

The ballot identity code 22 is a machine readable code that is printed on a bottom edge of the ballot paper 20. The ballot identity code 22 includes a ballot bar code 26 and a ballot numeral reference 28 that includes digits, alphabets and a ballot hologram 30 uniquely associated with the ballot paper 20. The ballot bar code 26 is readable by a bar code reader (i.e. bar code scanner) that has decoder circuitry for analysing the bar code's image data provided by optical sensors and for sending bar code's content to an output port.

The voter's identity 24 includes a photo image 32 of a voter (not shown), an identity number 34 of the voter and a biometric identity 36 of the voter. The photo image 32 is printed below the ballot instruction field 42. The biometric identity 36 having an iris identification and a finger print identification.

The list of choices 38 on the ballot paper 20 are presented by more than multiple means. Referring to FIG. 1, the list of choices 38 on the ballot paper 20 are printed for the visually-abled as a first means. The second means, the list of choices 38 on the ballot paper 20 are touched on the surface of the ballot paper 20 at each choice 38 for the visually impaired. The third means, the list of choices 38 on the ballot paper 20 are touch-triggered audio playback of the available choices 38 for the illiterate and the visually impaired. There are usually at more than one choice 38 for voters to choose and perhaps a third choice 38 for neutral or abstain from voting.

The field of vote 40 includes a written part and a perforated part. The written part allows a visually-abled voter to use a writing tool to mark on the ballot paper 20. The perforated part 46 allows a visually-impaired voter to touch and made a choice 38 by pushing through a perforated area on the ballot paper 20 located below the choice 38.

The fields 22~642 mentioned above are laser printed on the ballot paper 20 whilst some fields that are meant for the visually impaired are perforated or punctured 44~46 to allow sensing by touch. One example is the Braille type of representation of written language in which characters are represented by patterns of raised dots 44.

The ballot paper 20 is a sheet with four straight sides having different fields visible on a front surface of the sheet. On the front surface, on the top side of the ballot paper 20 is the ballot instruction field 42. Below the ballot instruction field 42 field, on the left of ballot paper 20 is the photo identity 32 of the voter. On the right of the photo identity 32 are the voter's identity number 34, voter's biometric identity 36 having an image of the voter's iris and a finger print. The choices 38 to vote are presented below the personal information of the voter. The voter's choice 38 is made at the field of vote 40 located below the choices 38. At the bottom of the ballot paper 20 is the ballot identity code 22 that comprises the bar code 26, numeral reference 28 and the hologram 30.

The ballot paper 20 is constructed of paper material which has an approximate dimension of five inches long and five inches wide. The ballot paper 20 is in a square or a rectangular shape to facilitate the handling of the ballot paper 20. The handling can be by human hands or a machine 80. Apart from the metallic coil 142,146 embedded, the ballot paper 20 has metallic strips embedded at the top edge thereof. This is to provide an early detection of a metallic material by the machine 80. The ballot paper 80 is also watermarked for added security.

Figure 4:
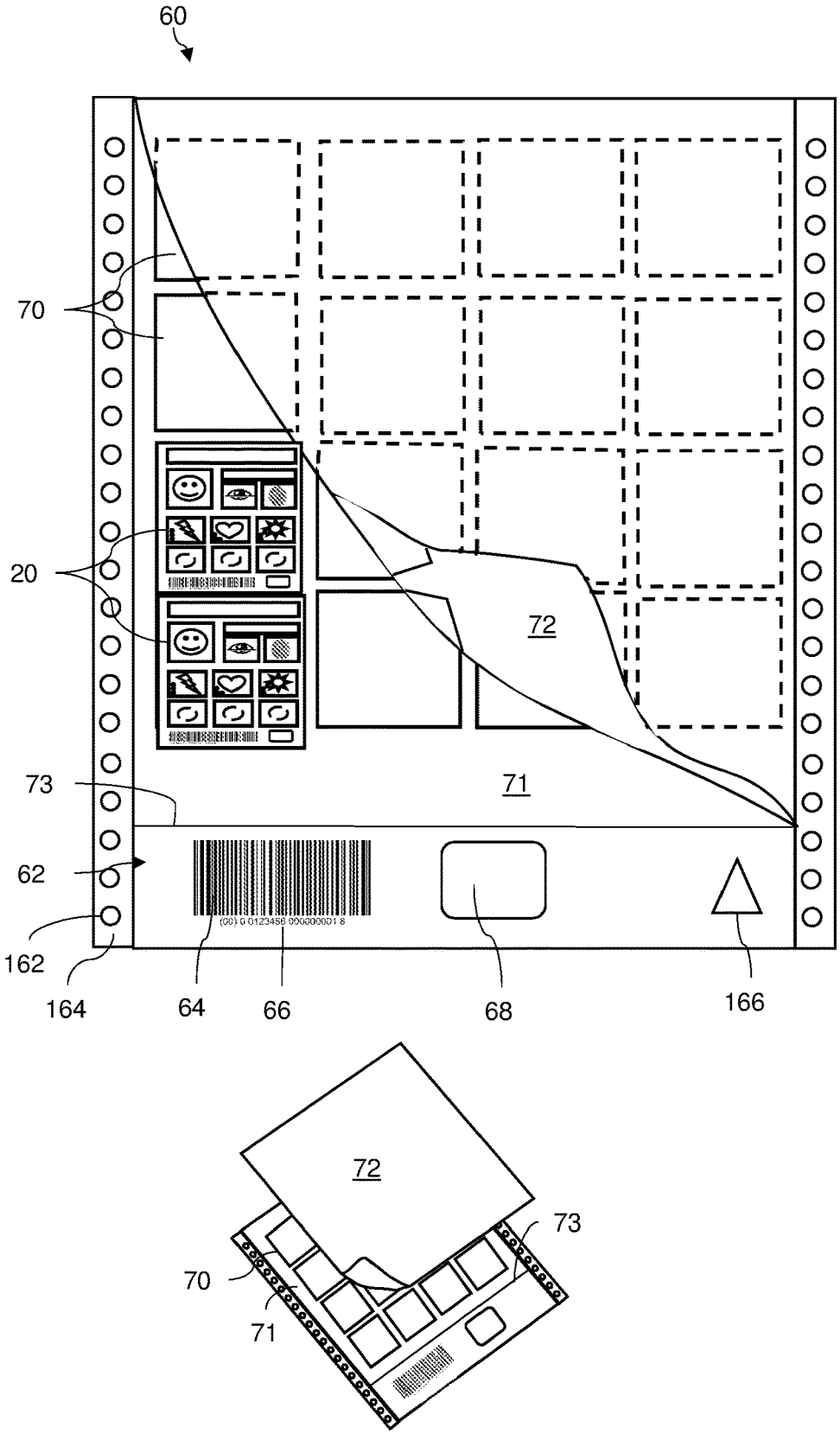
FIG. 4 is a schematic view of the tally record sheet according to the principles of the present invention.

FIG. 4 illustrates a tally record sheet 60 which comprises an adhesive sheet 70 below, a liner sheet 71 above and a backing sheet 72. The adhesive sheet 70 has an adhesive surface on a top side. The liner sheet 71 has a waxed surface at a bottom side and a non-waxed surface on an opposite side. The liner sheet 71 is affixed onto the adhesive surface 70. The liner sheet 71 has sixteen perforated squares arranged in a four-row by four-column grid. The liner sheet 71 remains a complete sheet with the sixteen square perforations. The perforations are punctured tiny slits formed along the perimeter of the sixteen squares. Along the two long sides of the liner sheet 71 is a plurality of through holes 162. The through holes 162 are made on a laminated strip 164. They are of the same construction as the ballot paper shown in FIG. 3. The liner sheet 71 has a wider width compare to the adhesive sheet 70 and the backing sheet 72. The breadth of the laminated strip is about 0.5 inches for the one long side. The two breadths have a sum of one inch.

The backing sheet 72 has an adhesive surface on a bottom side corresponding to the sixteen perforated squares on the liner sheet 71. The sixteen corresponding adhesive squares on the backing sheet 72 are aligned and affixed on the sixteen perforated squares on the liner sheet 71. The backing sheet 72 is smaller in size which is 22 inches long and 25 inches wide compare to the liner sheet 71 which is 25 inches long and 26 inches wide. The backing sheet 72 extends to a horizontal peel line 73. The horizontal peel line 73 straddles across a width of the liner sheet 71 and the adhesive sheet 70. The sixteen squares on the backing sheet 72 are perforated as well. However, the punctured holes on the backing sheet 72 are spaced further apart. One reason is to provide a stronger hold of the perforated squares on the backing sheet 72 when peeling off from the liner sheet 71. The second reason is to provide a tearing of the perforated square on the backing sheet 72 by the polling official 128. The tearing arises when the tally record sheet 60 is not fully adhered or pasted with the ballot paper 20 so that the perforated square on the liner sheet 71 remains intact thereon before feeding to the machine 80. There must be no adhesive area exposed when feeding to the machine 80. Otherwise, the machine 80 may be jammed.

At a bottom edge, on the non-waxed surface of the liner sheet 71 is a tally record identity 62. The tally record identity 62 includes a tally bar code 64, a tally character reference 66 and a tally hologram 68 to uniquely identify each tally record sheet 60. The tally record sheet 60 has the same EAS tag 154 embedded at the tally bar code 64 as illustrated in FIG. 3 of the ballot paper 20. The tally bar code 64 and the tally hologram 68 are formed on the liner sheet 71 during manufacturing and not simply pasted on the liner sheet 71. On the right side of the tally hologram 68 is an orientation mark 166 shaped as a triangle to indicate the orientation of the tally record sheet 60. The triangle is an isosceles triangle with an apex pointing upwards to indicate the direction and facing to place or insert the tally record sheet 60 into the ballot counting machine 80. The orientation mark 166 can also be printed on the ballot paper 20 providing the same function.

The tally record sheet 60 has four straight sides with four orthogonal angles. The tally record identity 62 is laser engraved at the bottom, front side of the tally record sheet 60 in a portrait orientation. The tally record sheet 60 is printed with a predetermined number of fields to provide a clear demarcated area for pasting the ballot papers 20. The adhesive is a reactive adhesive where the polymers on the front side of the tally record sheet 60 reacts with the adhesive on the back surface of the ballot paper 20 causing a chemical reaction to take place and adhering the two surfaces. The reactive chemicals can be a polyester resin and a polyurethane resin. The tally record sheet 60 is in a square or a rectangular shape to facilitate the handling. The handling can be by human hands or a machine 80.

The tally record sheet 60 is constructed of a paper material with the surface of the front side with adhesive specifically the adhesive sheet 70. The dimension of the tally record sheet 60 is approximately 25 inches long and 25 inches wide in order to provide space for the ballot papers 20 to be pasted on the adhesive surface of the adhesive sheet 70. Therefore, a tally record sheet 60 can stick at least sixteen ballot papers 20. The adhesive surfaces expose an area has an area of 4.5 inches by 4.5 inches that is smaller than the area of the ballot paper 20 which 5 inches long by 5 inches wide. The smaller area ensures that the whole adhesive area is covered by the ballot paper 20 before feeding to the machine 80. There is a gap of 0.5 inch between each adhesive square on the liner sheet 71. There is a margin of 0.5 inch from the top and the two lengths of the liner sheet 71 when seen in a portrait orientation where the tally record identity 62 is at the bottom of the liner sheet 71.

The function of the ballot paper 20 is an indication of the voter's decision. With reference to FIG. 2, the fields 22~46 are intended to identify the ballot paper 20 and the voter's identity 24 uniquely. One ballot paper 20 is associated to one voter only. In some cases, voter's identity is concealed so as not to implicate the voter for his vote. As a result, the voter's identity 24,32,34,36 section may have to be removed from the ballot paper 20 depending on the requirements of the polling.

The electronic article surveillance (EAS) tag 154 provides a means for detection by the transmitter pedestal 138 and the receiver pedestal 140 located at the exit 132. The transmitter pedestal 138 emits a frequency range of 7.4 MegaHertz to 8.8 MegaHertz and received by the receiver pedestal 140. The EAS tag 154 with the relevant inductor and capacitor values generate a frequency of 8.2 MegaHertz. If anyone were to walk through the pedestals 138,140 with the ballot paper 20 or the tally record sheet 60, the receiver pedestal 140 will receive a re-radiated frequency signal which deviates from the original frequency range of 7.4 MegaHertz to 8.8 MegaHertz. The deviation triggers an audible alarm from a speaker (not shown) which is located inside the receiver pedestal 140. The following paragraph provides a clearer description on the operation of the EAS tag 154.

During the manufacturing of the EAS tag 154, the capacitor within is charged. Once charged, the LC (inductor-capacitor) circuit will oscillate at a resonating frequency determined by the values of the inductor and the capacitor. The resonating frequency, f is determined by the formula:

$$f = \frac{1}{2\pi\sqrt{LC}}$$

The metal coils 142,146 of the EAS tag 154 provide an antenna to receive the transmitted frequency from the transmitter pedestal 138. At the end of the antenna is a small diode or resistor-capacitor (RC) circuit that causes the EAS tag 154 to emit a radio signal in response to the radio signal it receives from the transmitter pedestal 138. The EAS tag 154 goes from active to saturated by the transmitter pedestal 138. The receiver pedestal 140 detects the change in the amount of signal picked up from the transmitter pedestal 138.

To disarm the EAS tag 154, a strong RF pulse (i.e. much stronger than what the gates emit) blasts the EAS tag 154 and burns out the diode or RC components. However, at the polling centre 124 the disarming feature is normally not used.

The function of the tally record sheet 60 is to stick the ballot papers 20. After sorting and counting of the ballot papers 20, the ballot papers 20 are pasted onto the front side of the tally record sheet 60 which is adhesive. The ballot papers 20 on the tally record sheet 60 are seen visually and provides easy counting. The tally record identity 62 is to provide identification and to provide association of the tally record identity 62 with the ballot identity code 22. The pasting of the ballot papers is performed by the polling official 128.

The ballot paper 20 and the tally record sheet 60 are marked with watermark on the either one surface or both surfaces of the respective sheets for added security. Added security feature like metallic strips are embedded in the ballot sheet 20 and the tally record sheet 60. Alternatively, the ballot paper 20 and the tally record sheet 60 are constructed using durable materials like plastic sheet or metal sheet for permanent record The adoption of plastic or metal provides reusability.

Electronic chips like RFID (Radio Frequency Identification) can also be embedded into the ballot paper 20 and the tally record sheet 60 for privacy purpose. A naked eye is unable to read sensitive information on the sheet for fields that are hidden.

The ballot paper 20 is possibly embedded with a speaker to project an audible sound to the visually impaired or the illiterates. The embedded speaker requires electronic circuitry connected an internal or an external power source to activate the embedded speaker.

The visibility of the ballot paper 20 can be transparent, opaque or partially opaque to the human eyes. On a back surface of the ballot paper 20 can be a layer of non-reactive adhesive which does not use chemical reactions of two chemicals for adhesion. In one example, the layer of non-reactive adhesive includes pressure-sensitive adhesive used by the trademarked name of "Post-it". Another adhesive alternative can be a reactive adhesive using polymers to cross-link into acrylics, urethanes and epoxies. For example, a polymer resin applied on the back surface of the ballot paper 20 and a polyurethane resin applied on another surface like a tally record sheet 60 described in FIG. 4.

Figure 5:
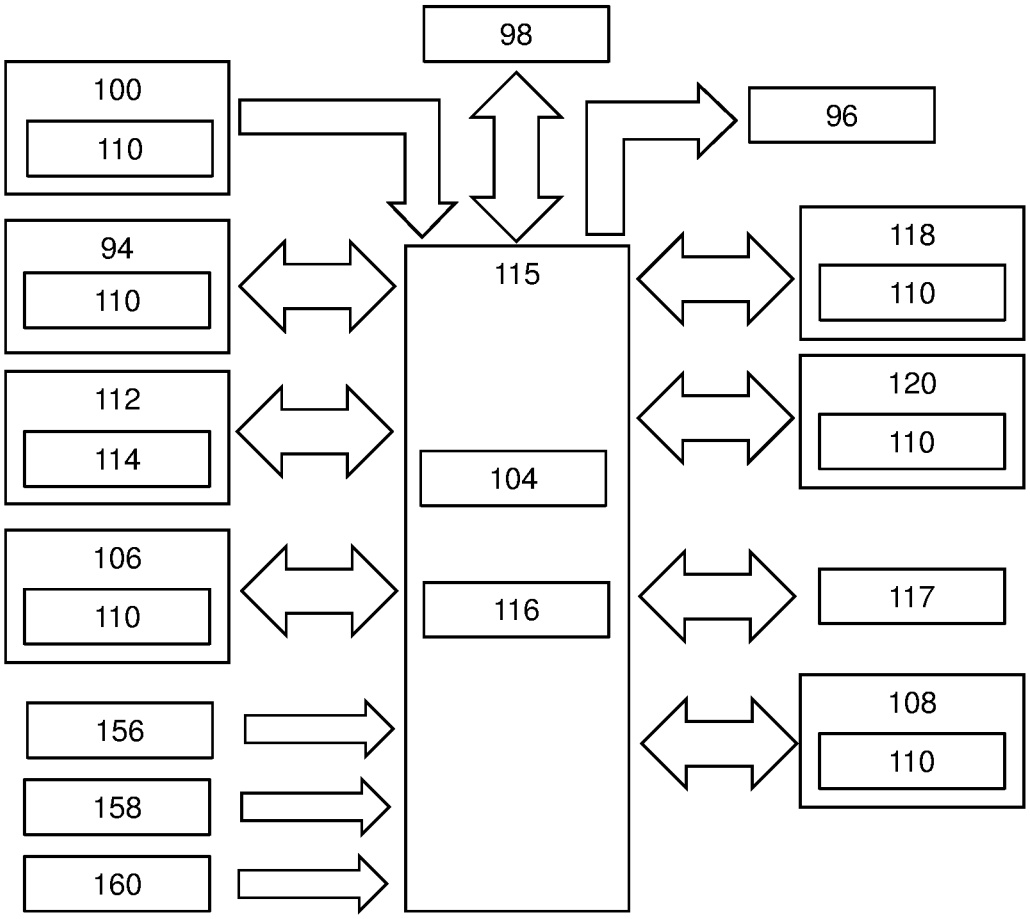
FIG. 5 is a schematic view of the internal components of the ballot counting machine according to the principles of the present invention.

FIG. 5 illustrates a schematic diagram of internal components 104 of the ballot vending machine 80 according to FIG. 2. The schematic diagram of the ballot counting machine 80 comprises a plurality of sensors 110, a ballot reader 112 having an image capturing device 114, a read-only memory 116 that has a software or firmware program embedded, a microcontroller 115, a communication module 117, a sorter 118 and an applicator 120.

The microcontroller 115, the read-only memory 116 are surface mounted onto a printed circuit board. A printed circuit board (not shown) of the ballot vending machine 80 has embedded electrical connections to input and output ports. The input and output ports provide communication channels to and from the sensors 110, the tactile display 98, the front access door 100, the ballot insertion tray 94, the tally feeder tray 106, the communication module 117, the ballot reader 112 with the image capturing device 114, the sorter 118, the applicator 120, the tally feeder tray 106, the report feeder tray 108 and a report printer 96. The communication module 117 deploys network communication protocols that include TCP/IP, IPX/SPX, X.25, AX.25, and AppleTalk. The ballot vending machine 80 is capable of communicating with another ballot vending machine (not shown) remotely or in proximity using wired or wireless communications based on the listed network communication protocols. The wireless communication protocols include WiFi, Bluetooth, NFC (Near Field Communications) and 3G, 4G and LTE (Long-Term Evolution), which are provided by one or more telecommunication service providers, such as SingTel, M1 or StarHub, Verizon Wireless, AT&T Mobility, T-Mobile, Sprint Corporation and US Cellular. Data transmission across communication channels to other distant ballot counting machines are encrypted using AES (Advanced Encryption Standard).

The accessibility of the ballot counting machine 80 using remote computer provide troubleshooting and maintenance in the event that the polling official 128 has problem accessing the machine 80.

A camera 156 and a microphone 158 are positioned at the front top part 90 of the ballot counting machine 80. The camera 156 facilitates real time interaction with a remote user. The other use of the camera 156 is video recording of events, for example, tampering (misuse) of the machine 80 or recording the use of the ballot vending machine 80. The microphone 158 provides audio feedback of the environment as well as communicating with the remote user.

The front access door 100 of the ballot vending machine 80 has a sensor 110. When the front access door is ajar, the sensor 110 detects and sends an interrupt signal to the microcontroller 115. The microcontroller 115 will then output a message on the tactile display 98 "Front Door Open. Please close the door".

The ballot insertion tray 94 and the tally feeder tray 106 have additional sensors 110 to detect the presence of the ballot paper 20 and the tally record sheet 60 respectively. If there were no authorized ballot paper feeding from either of the trays 91,106, the microcontroller 115 will sound an audible alarm and cause to display a message on the tactile display 98, "Ballot Paper not found in the tray" or "Tally Record Sheet not found in the tray."

The report feeder tray 108 has a sensor 110 that informs the microcontroller 115 that there is no paper found in the tray. The microcontroller 115 will sound an audible alarm and display a message on the tactile display 98, "Paper not found in the report feeder tray". Once paper is detected, a report of the analysis done by the microcontroller will be printed at the report printer 96.

The ballot reader 112 has an image capturing device 114 that acquires the images of the ballot paper 20 and send to the microcontroller 115 for processing. Based on the entered variables by the polling official 128, the microcontroller 115 will execute instructions as programmed like counting the total ballot paper 20, counting the ballot paper 20 that chose a first option, counting the ballot paper 20 that chose a second option.

The sorter 118 has a sensor 110 that detects a possible jam within the ballot counting machine 80. The applicator 120 has a sensor 110 that detects a possible jam within the ballot counting machine 80.

There is a Global Positioning System (GPS) 160 positioned on top of the ballot counting machine 80. The GPS 160 is linked to the microcontroller 115 having real time location tracking. A detected location is saved inside the read-only memory 116 for reference. This is a safety feature provided to know the location of the ballot counting machine 80. During a polling day, last minute verification of the location of the machine 80 can be done remotely via the communication module 117.

Figure 6:
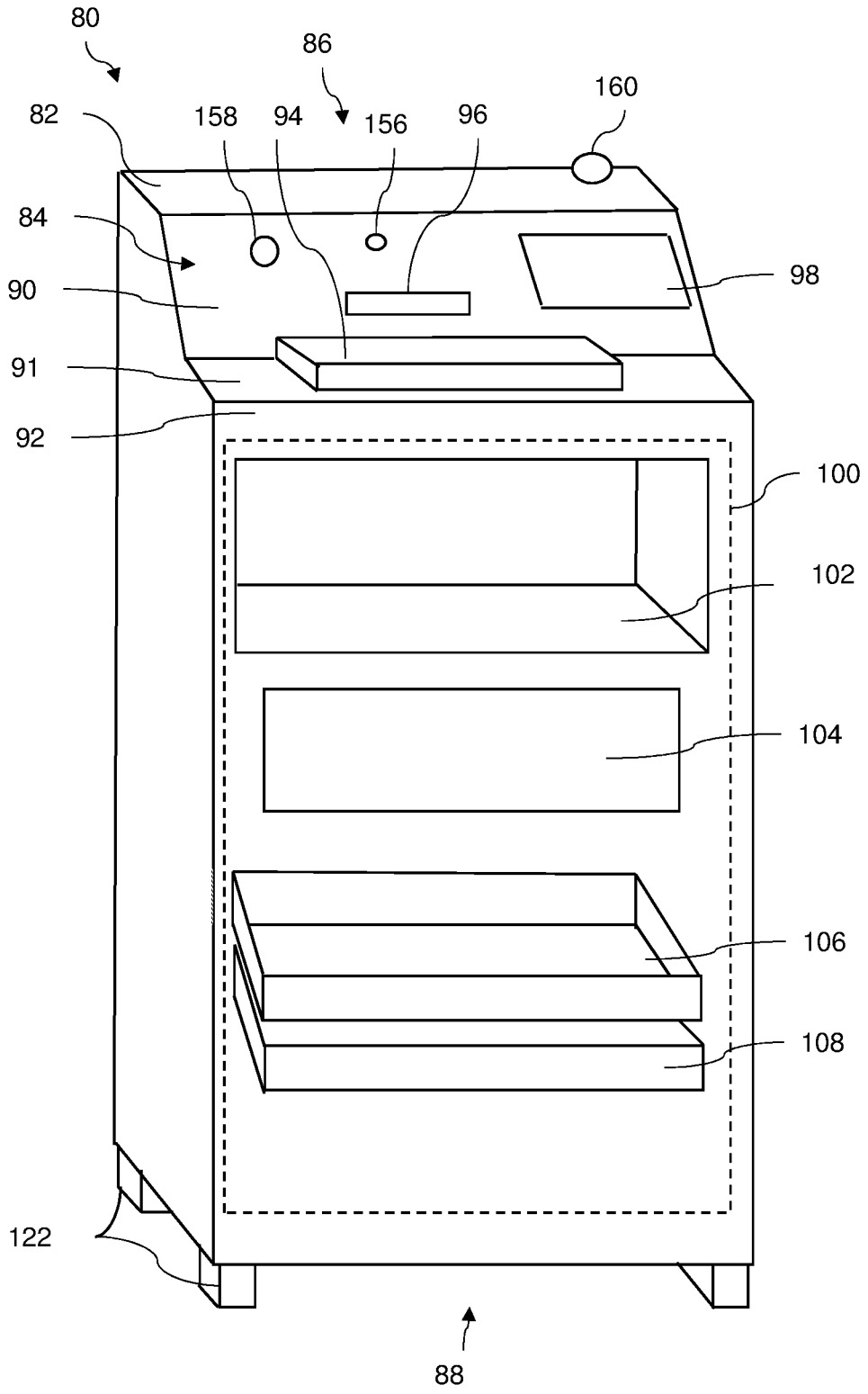
FIG. 6 is a perspective view of a ballot counting machine according to the principles of the present invention.

FIG. 6 illustrates the ballot counting machine 80 having a protective housing 82 comprising a front section 84, a rear section 86 and a base section 88. The front section 84 as seen from a front side is made up of a front top part 90 and a front upright part 92. The front top part 90 is inclined rearward. The front upright part 92 is orthogonally disposed relative to a horizontal ground. As seen in an isometric view as shown in FIG. 6, there is also a front horizontal platform 91. The front horizontal platform 91 forms one contiguous front section 84 with the front top part 90 and the front upright part 92. From the rearward biased front top part 90, the front horizontal platform 91 is formed thereto which is horizontally disposed relative to the ground. The front upright part 92 is orthogonally formed from the front horizontal platform 91.

On the rearward biased front top part 90 is a tactile display 98 located on a right side. The report printer 96 is located at the centre of the front top part 90. The camera 156 is located above the report printer 96. The microphone is located at a left side of the front top part 90. On the front horizontal platform 91 is a ballot insertion tray 94.

The front upright part 92 has a front access door 100 that provides easy access into an interior of the ballot counting machine 80 for maintenance and set up activities. The interior contains an output tray 102 at a top level, a tally feeder tray 106 and a report feeder tray 108 at the bottom levels. A block of internal components 104 illustrates a plurality of peripherals and connections from the microcontroller 115 to the external peripherals. The external peripherals are inside and on the protective housing 82 of the ballot counting machine 80.

In addition, various access doors (not shown) are included to provide access to a variety of switches, connections and interfaces. At the rear side of the ballot counting machine 80 is a three-wired cable (Live-Neutral-Ground) terminated by a 3-pinned plug. The 3-pinned plug is plugged into a wall socket to obtain an electricity supply (220 to 240 Volts) from the utilities. Inside the ballot counting machine 80 is a transformer that steps down an input high voltage to a low voltage typically 12 Volts and 3.3 Volts. The 12 Volts supply feeds the sorter 118, the applicator 120, the report printer 96, the tactile display 98 and others. The 3.3 Volts supply feeds the microcontroller 115, the communication module 117 and others. The ballot counting machine 80 also has a strapping tensioner that bundles a stack of tally record sheet 60 or a stack of ballot paper 20 together by strapping a cable and sealing the cable with a seal.

The rear section 86 of the protective housing 82 having a rear access door (not shown) provides a locked access to the internal of compartment which includes a plurality of external ports (not shown), such as a USB hub and other types of standard ports like Ethernet port (RJ45 port), D-subminiature connectors and SCSI (Small Computer System Interface) connector.

The base section 88 of the protective housing 82 has a plurality of base support 122 at the bottom of the base section 88. The base support is fitted with castor wheels for the purpose of mobility.

The front top part 90 provides access to a ballot insertion tray 94, a report printer 96 and a tactile display 98 which are easily accessible by a normal human height when standing up. Components at the front top part 90 of the ballot counting machine 80 facilitate commonly used functions of the ballot counting machine 80. The camera 156 and the microphone 158 are positioned at the front top part 90 of the ballot counting machine 80. There is also the Global Positioning System (GPS) 160 positioned on top of the ballot counting machine 80.

The ballot insertion tray 94 is provided to receive a ballot 20 for scanning and counting. The ballot insertion tray 94 is constructed into the front top part 90 of the protective housing 82 and is approximately nine inches wide in order to accommodate a five inches' sheet of ballot paper 20. The ballot insertion tray 94 can, however, be able to fit any size ballot. An embossed icon (not shown) indicating the proper orientation and proper facing of the ballot is moulded onto the ballot insertion tray 94. An anti-static element to reduce static is installed in the ballot insertion tray 94 as well.

The tactile display 98 is an LED (light emitting diode) touch screen display in a landscape orientation. The tactile display 98, may be standard, off-the-shelf component which is readily available and well known in the art.

In use, the ballot paper 20 is marked by a voter 126 indicating his choice 38. For a visually-abled voter 126, a pencil or a pan is used to indicate his choice 38. However, if a voter (not shown) is visually impaired, the visually impaired voter has to puncture on the perforated 46 ballot paper 20 to indicate the choice 38.

After the voting has ended, the polling official 128 overseeing the voting campaign will sort and count the votes in the sealed ballot box 127. The sorted ballot papers 20 are then manually pasted onto a tally record sheet 60. The tally record sheet 60 comes with the backing sheet 72. When in use, the backing sheet 72 is peeled off to reveal the adhesive surface of the adhesive sheet 70.

In a scenario where there were two choices 38, there would be two tally record sheets 60. One tally record sheet 60 for one choice 38. A third tally record sheet 60 can be for the abstain and invalid ballot papers 20.

If there were fifty voters, thirty voters chose "A", fifteen voters chose "B" and five voters abstain. The thirty ballot papers 20 that chose "A" will be pasted on a first tally record sheet 60. The fifteen ballot papers 20 that chose "B" will be pasted on a second tally record sheet 60. The remaining five ballot papers 20 that did not vote or invalid ballot papers 20 due to defacing or other reasons will be pasted on a third tally record sheet 60.

Further to the above example, according to the dimensions of twenty-five inches long and twenty-five inches wide of the tally record sheet 60, sixteen ballot papers 20 of dimensions five inches by five inches are able to fit onto one tally record sheet 60. The fifteen ballot papers 20 that chose "B" with fifteen different identity codes 22 are associated with one tally record identity 62.

The thirty ballot papers 20 that chose "A" will use two sheets of the first tally record sheet 60. The fifteen ballot papers 20 that chose "B" will use one sheet of the second tally record sheet 60. The five ballot papers 20 that are invalid or abstained will use one sheet of the third tally record sheet 60.

Hence, the total tally record sheets 60 used for the fifty voters are four sheets of tally record sheet 60. In operation, the ballot counting machine 80 provides several modes.

In a first mode, the ballot counting machine 80 provides a method of counting of either the ballot paper 20 or the tally record sheet 60. The ballot paper 20 is first loaded at the ballot insertion tray 94 which is located at the front horizontal platform 91. The polling official 128 performs the count of the ballot paper 20 by touching a button (not shown) on the tactile display 98 to activate the counting process. The counting comprises the steps of first, detecting the ballot paper 20 by sensors 110 at the ballot insertion tray 94. Secondly, feeding the counter in the machine 80 by mechanical means like gears cooperating with rollers. The ballot paper 20 have through holes 162 on the two laminated strips 164 at the two lengths thereof. The laminated strips having the rough surfaces provide frictional grip of the ballot paper 20 by the mechanical means. Additional mechanical means include corresponding circular gears with concentric protrusions on its peripheries which latch on the through holes 162. Thirdly, detecting invalid ballot paper 20 by using ultraviolet (UV) light sensors 110 and using magnetic sensors 110. The ballot paper 20 has metallic material embedded and watermarked that is detectable by ultraviolet light. The machine 80 will halt the count process and produce an audible alarm from a speaker (not shown) when an invalid (counterfeit or folded or tampered) ballot paper 20 is found. The tactile display 98 having a backlit will also flash on and off. Finally, increase the count for each successful count and store in the memory of the microcontroller 115. The counter has a machine reader for capturing the information on the ballot paper 20.

The same method of count applies for the tally record sheet 60. The tally record sheet is loaded at the tally feeder tray 106 inside the ballot counting machine 80. The tally record sheet 60 are loaded inside because they are controlled items and can only be handled by authorised personnel. The polling official 128 performs the count of the tally record sheet 60 by touching a button (not shown) on the tactile display 98 to activate the counting process.

In a second mode, the ballot counting machine 80 provides a method of sorting the ballot paper 20 comprising the steps of first, touching the tactile display 98 on the sorting function. The machine 80 is intelligent to detect the location of the ballot paper 20 and perform the sort. For example, if the ballot papers 20 are detected at the ballot insertion tray 94, the machine 80 automatically fetches the ballot papers 20 and sort. If the ballot papers 20 are inside the machine 80, the machine automatically detects the ballot papers 80 inside and perform the sort. In the cited two scenarios, the ballot papers 20 are to go to the sorter 118. Secondly, the ballot papers 20 are conveyed to the sorter 118 mechanically via gears and rollers cooperating with the through holes 162 and the textured (roughened) laminated strips 164. The machine 80 will scan the top surface of the ballot paper 20 searching for the field of vote 40. Thirdly, the determining a sorting criteria. The sorting criteria is determined by the choices 38 and the field of vote 40. The field of vote 40 shows the voter's 126 indication either by a crossing or tearing the perforated part 46. The machine 80 will have the foreknowledge of the location of the field of vote 40 because the vital information (position of the fields, length, breadth, weight, thickness, security features, identification) of the ballot paper 20 has already been programmed.

The machine 80 also has the foreknowledge of the number of choices 38 on the ballot paper 80. If there were two choices 38, the machine 80 will sort into three different stacks or bins. The third stack or bin is the invalid ballot paper 20. In other words, the determination of the number of bins is the number of known choices 38 plus one invalid. The polling official 128 may have to verify the invalid ballot papers 20 after the sorting. Thirdly, capturing an image of the ballot paper 20 specifically the field of vote 40.

The ballot paper 20 is examined by an image capturing device 114 wherein the image is analysed by a software program embedded in the read-only memory 116. The software program will capture the contents on the ballot paper 20 comprising the ballot identity code 22, the photo identity 32 of the voter, the identity number 34 of the voter, the biometric identity 36 of the voter 126 which may be the iris or the fingerprint, and the field of vote 40 that the voter 126 had chosen. The software program detects which choice 38 has been selected by the voter 126. The software program will increase the count for each choice. The software program will also separate the ballot paper 20 according to the choice 38. The software program tests the validity of the ballot paper 20 and sort according to the choices 38 being programmed into the ballot counting machine 80 before the sorting and counting beings. The testing of the ballot paper 20 includes detecting the ballot identity code 22, detecting the voter's identity 24, detecting the size of the ballot paper, detecting the thickness and weight of the ballot paper 20. This is to ensure that the ballot paper 20 is authentic and only used for the particular polling campaign. Finally, the sorted ballot papers 20 are found inside the ballot counting machine 80 at the output tray 102.

In a third mode, the ballot counting machine 80 provides a method of programming comprising the steps of first, setting the choices 38 specific to the polling campaign. For example, if there were two choices for voters to choose. The ballot counting machine 80 has to be programmed to recognise the two choices. The polling official 128 programs the machine 80 using the tactile display 98 at the front top part 90. The polling official 128 enters the choices 38 that are contesting in the voting campaign. The choices 38 to be programmed are similar to the ones presented on the ballot paper 20. Characters of the choices 38 are to be entered using the tactile display 98 which has a QWERTY keyboard displayed on the screen. Representations of the choices 38 like pictures are to be inserted at the ballot insertion tray 34 to allow the images to be captured by the image capturing device 114. The captured images are then stored in the ROM (read only memory) in the machine 80. The polling official 128 can also program the areas of where the authentication means are on the ballot paper 20. Just to highlight, there is a plurality of image capturing device 114 located at different positions inside and outside the ballot counting machine 80. The polling official 128 can also program the counter to stop at a certain number. For example, if a number of fifty is set. The counter will stop counting once it reaches fifty. The polling official can then remove a first set of fifty ballot sheets 20 and start the count again to get a second set of fifty ballot papers 20. On the tactile display 98, there will be a running number showing 0 to 50 and another number showing the cumulative count, in this example will show 100. In the event, an invalid ballot paper 20 is found, the counter and the count are stopped for the polling official to confirm.

Secondly, determining the relevant fields to capture. The polling official 128 has the ability to determine which fields to capture. For example, the identity of the voter 126 which is optional. By default, all information on the ballot paper 20 is captured and stored in the read-only memory 116. Once the machine is programmed, the machine can perform functions like sorting, counting and authenticating. The same method applies for the tally record sheet 60.

In a fourth mode, the ballot counting machine 80 provides a method of applying the ballot paper 20 onto the tally record sheet 60 comprises the step of firstly, loading the tally record sheet into the tally feeder tray 106. Secondly, loading the ballot paper 20 into the ballot insertion tray 94. Thirdly, peeling the backing sheet 72 of the tally record sheet by the applicator 120. Fourthly, adhering the ballot papers 20 onto the adhesive tally record sheet 60 by the applicator 120. The applicator 120 has rollers that will pick up the ballot papers 20 and rolled onto the sticky surface of the tally record sheet 60. The tally record sheet 60 is fed from the tally feeder tray 106. The back surface of the ballot paper 20 is applied onto the adhesive sheet 70 of the tally record sheet 60. The tally record sheet 60 is uniquely identified by the tally record identity 62. The tally record identity 62 can be presented using a tally bar code 64, using a tally character reference 66 or using a tally hologram 68 to uniquely identify each tally record sheet 60. Finally, the tally record sheet 60 with the pasted ballot papers 20 is then guided to the output tray 102 from the applicator 120 where the polling official 128 can verify the result.

Alternatively, the back surfaces of the ballot papers 20 may have an adhesive like a polyester resin applied thereon. The front surface of the tally record sheet 60 has a layer of polyurethane resin applied. The application of the ballot papers 20 on the tally record sheet 60 causes a chemical reaction and bond the two surfaces. At the same time, the heat from the applicator 120 cures the bond producing a stronger adhesive.

At the end of the voting campaign, a report can be generated by sending a print command via the tactile display 98. The report is printed from the report printer 96 where the paper is fed from the report feeder tray 108.

A method of assembling the ballot paper 20 comprises the step of first, forming the shape of the ballot paper 20 using a die cast. The die cast predetermines the shape and size of the ballot paper 20 providing a consistent quality output. The die cast also determines the position of embedding the following layers by indentation. Secondly, laying of the lower metal coil layer 142 at a position. The position is at the bottom edge of the ballot paper 20. Thirdly, laying of the dielectric material 144 above the lower metal coil layer 142. Fourthly, laying of the upper metal coil layer 146 above the dielectric material 144. Fifthly, laying of the top surface of the barcode label 152 above the upper metal coil layer 146 and applying an adhesive on the back side of the top surface of the barcode label 152. The adhesive adheres to the top surface of the ballot paper 150 securing the metal coil 142,146 and the dielectric material 144. Finally, inscribing on the ballot paper 20. This step involves using laser engraving on the ballot paper 20 to ensure a permanent impression. Relevant information like that voter's identity 24, the choices 38, the field of vote 40 and the ballot identity code 22 are laser engraved too. The step further includes punching holes at the choices 38 according to the Braille standard. This step also includes making perforations in the field of vote 40 allowing the voter 126 to tear the perforation from the ballot paper 20.

A method of assembling the tally record sheet 60 comprises the step of first, forming the adhesive sheet 70 providing base sheet so that the other sheets are applied thereon. The top side of the adhesive sheet contains adhesive. Secondly, forming the liner sheet 71. The liner sheet 71 is perforated at certain area having perforated holes along the perimeter of the certain area. The bottom side of the liner sheet 71 is a waxed surface. Thirdly, applying the liner sheet 71 which has the perforation line onto the adhesive sheet 70. Fourthly, forming the backing sheet 72. The backing sheet 72 has corresponding perforation lines to the liner sheet 71. The perforation line on the backing sheet 72 has longer gaps between each perforated hole along the perimeter of the certain area to ensure that the perforated areas are not torn off easily. The bottom side of the backing sheet 72 contains adhesive at the perforated areas only. The backing sheet 72 is formed slightly shorter in length compare to the adhesive sheet 70 and the liner sheet 71. All the three sheets 70,71,72 has the same width. Fifthly, attaching the backing sheet 72 onto the liner sheet 71. The sticky backing sheet 72 is aligned and adhered to the corresponding perforated areas on the liner sheet 71. Finally, attaching the metal wire coils 142,146 and the dielectric material 144 at a location on the tally record sheet 60. Then laser engraving of the barcode and other security features thereon.

Alternatively, if the display is not a tactile display 98, the ballot counting machine 80 would also include another type of input device, such as a keypad, a joystick, a pointing device, a trackball or a touch pad. In such a configuration, the display would be connected to the ballot counting machine 80 through a dedicated input, output connector of the said device 80. Other types of displays and input devices are possible and within the scope of the present application.

In the application, unless specified otherwise, the terms "comprising", "comprise", and grammatical variants thereof, intended to represent "open" or "inclusive" language such that they include recited elements but also permit inclusion of additional, non-explicitly recited elements.

As used herein, the term "about", in the context of concentrations of components of the formulations, typically means+/−5% of the stated value, more typically +/−4% of the stated value, more typically +/−3% of the stated value, more typically, +/−2% of the stated value, even more typically +/−1% of the stated value, and even more typically +/−0.5% of the stated value.

Throughout this disclosure, certain embodiments may be disclosed in a range format. The description in range format is merely for convenience and brevity and should not be construed as an inflexible limitation on the scope of the disclosed ranges. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

It will be apparent that various other modifications and adaptations of the application will be apparent to the person skilled in the art after reading the foregoing disclosure without departing from the spirit and scope of the application and it is intended that all such modifications and adaptations come within the scope of the appended claims.

REFERENCE NUMERALS

20 ballot paper
22 ballot identity code
24 voter's identity
26 ballot bar code
28 ballot numeral reference
30 ballot hologram
32 photo identity or photo image
34 identity number
36 biometric identity
38 choices
40 field of vote
42 ballot instruction field
44 patterns of raised dots
46 perforated part
60 tally record sheet
62 tally record identity
64 tally bar code
66 tally character reference
68 tally hologram
70 adhesive sheet
71 liner sheet
72 backing sheet
73 horizontal peel line
80 ballot counting machine or machine
82 protective housing
84 front section
86 rear section
88 base section
90 front top part
91 front horizontal platform
92 front upright part
94 ballot insertion tray
96 report printer
98 tactile display
100 front access door
102 output tray
104 internal components
106 tally feeder tray
108 report feeder tray
110 sensors
112 ballot reader
114 image capturing device
115 microcontroller
116 read-only memory
117 communication module
118 sorter
120 applicator
122 base support
124 polling centre
126 voter
127 ballot box
128 polling official
130 polling station
132 exit
134 first arrow
136 second arrow
138 transmitter pedestal
140 receiver pedestal
142 lower metal coil layer
144 dielectric material
146 upper metal coil layer
148 insulation layer

150 top surface of the ballot paper
152 top surface of the barcode label
154 electronic article surveillance (EAS) tag
156 camera
158 microphone
160 global positioning system (GPS)
162 through holes
164 laminated strip

The invention claimed is:

1. A ballot counting tool, comprising a sheet material having a predetermined number of receptacles for receiving ballot papers respectively, the receptacles being adjacent to each other and aligned in a grid pattern;

at least one catch on the sheet material for keeping the ballot sheets to the receptacles respectively, the at least one catch having multiple recesses configured to be affixed to the ballot papers;

a detachable clasp configured to be joined to another ballot counting tool; and a tally record identity providing a clear demarcated area to paste the ballot papers, wherein an electronic article surveillance (EAS) tag is embedded in the tally record identity;

wherein the receptacles are configured to be fitted to the ballot sheets respectively;

wherein the ballot counting tool is made of a laminated paper comprising an adhesive sheet on a bottom side, a backing sheet on a top side, and a liner sheet sandwiched between the adhesive sheet and the backing sheet, wherein the liner sheet has a waxed surface at the adhesive sheet and a non-waxed surface at the backing sheet, and wherein the backing sheet extends to a horizontal peel line and is smaller than the liner sheet;

wherein the ballot counting tool has a rectangular shape in order to facilitate handling thereof; and wherein each of the receptacles has a smaller size than a corresponding one of the ballot papers.

2. The ballot counting tool of claim 1, further comprising a roughened area on the sheet material for retention of the ballot counting tool.

3. The ballot counting tool of claim 1, wherein the at least one catch comprises a transparent layer for covering at least one of a plurality of predetermined fields.

4. The ballot counting tool of claim 1, wherein the at least one catch further comprises an adhesive for affixing the ballot sheets to the predetermined number of receptacles.

5. The ballot counting tool of claim 1, wherein the at least one catch further comprises a fastener for affixing the ballot sheets to the predetermined number of receptacles.

6. The ballot counting tool of claim 1, wherein the predetermined number of receptacles are aligned on the ballot counting tool according to a regular pattern.

7. The ballot counting tool of claim 1, further comprising an identification code for organising multiple pieces of the ballot counting tool.

8. The ballot counting tool of claim 7, wherein the identification code comprises a machine readable identification code.

9. The ballot counting tool of claim 1, further comprising at least one through hole for joining another ballot counting tool.

10. A ballot sheet for being counted by the ballot counting tool according to claim 1, the ballot sheet comprising:

a predetermined number of zones showing information of candidates for balloting, the information being shown in multiple means comprising a visual means, a touched means, an audio means or a combination thereof;

an area on the ballot sheet showing identification information of a voter, the identification information comprising a photo image, an identity number and a biometric identity of the user;

a part having an identifier;

a field of vote comprising a written part and a perforated part;

a ballot instruction field on a top side of a front surface of the ballot sheet;

an identification code configured to compile multiple pieces of a corresponding one of the ballot sheets;

a plurality of through holes along two long sides of the ballot sheet;

an electronic article surveillance (EAS) tag configured to be detected by a transmitter pedestal and a receiver pedestal; and at least one metallic strip embedded at a top edge of the ballot sheet;

wherein the ballot counting tool is configured to be affixed to the ballot sheet in order to tabulate the ballot counting tool;

wherein the ballot sheet is made of a laminated paper; and wherein the ballot sheet has a rectangular shape in order to facilitate handling thereof.

11. The ballot sheet of claim 10, further comprising at least one disability assistive feature for balloting.

12. The ballot sheet of claim 11, further comprising an adhesive for attaching the ballot sheet to at predetermined field of the ballot counting tool.

13. The ballot sheet of claim 11, wherein at least one portion of the ballot sheet is opaque.

14. The ballot sheet of claim 11, wherein the identifier comprises an electronic circuit for automatically tracking the ballot sheet.

15. A ballot counting machine, comprising:

a receptacle receiving at least one ballot counting tool according to claim 1;

a dispenser discharging the at least one ballot counting tool; and a counter numbering the at least one ballot counting tool or balloting sheets on the at least one ballot counting tool;

an output tray, a tally feeder tray and a report feeder tray inside the ballot counting machine, the output tray being at a top level, and the tally feeder tray and the report feeder tray being at bottom levels;

a ballot insertion tray on a front horizontal platform outside the ballot counting machine; and an applicator configured to fix the ballot sheets to the at least one ballot counting tool for reading by the counter, wherein the applicator has a sensor configured to detect a possible jam within the ballot counting machine.

16. The ballot counting machine of claim 15, wherein the counter comprises a machine reader for capturing information on the at least one ballot counting tool or the balloting sheets.

17. The ballot counting machine of claim 15, further comprising a sorter for automatically stacking multiple pieces of the at least one ballot counting tool.

18. The ballot counting machine of claim 15, further comprising a tracking tool configured to locate the ballot counting machine.

19. The ballot counting machine of claim 15, further comprising a communication terminal configured to transmit an electronic signal to a remote electronic device.

20. The ballot counting machine of claim 15, further comprising an unique electronic address as an identification of the ballot counting machine.

* * * * *